US006605187B1

(12) United States Patent
Nonomura et al.

(10) Patent No.: US 6,605,187 B1
(45) Date of Patent: Aug. 12, 2003

(54) METHOD FOR PRODUCING PULP MOLDED ARTICLE

(75) Inventors: Akira Nonomura, Tochigi-ken (JP); Yasushi Yamada, Tochigi-ken (JP); Hisao Sato, Tochigi-ken (JP); Tokuo Tsuura, Tochigi-ken (JP); Hiroaki Kobayashi, Tochigi-ken (JP)

(73) Assignee: Kao Corporation, Tokyo (JP)

( * ) Notice: Subject to any disclaimer, the term of this patent is extended or adjusted under 35 U.S.C. 154(b) by 25 days.

(21) Appl. No.: 09/713,230

(22) Filed: Nov. 16, 2000

(30) Foreign Application Priority Data

Nov. 17, 1999 (JP) ..... 11-327371
Apr. 3, 2000 (JP) ..... 2000-100685

(51) Int. Cl.[7] ..... D21H 25/04; D21J 1/00
(52) U.S. Cl. ..... 162/224; 162/226; 162/227
(58) Field of Search ..... 162/218, 226, 162/227, 224, 396; 264/322, 324

(56) References Cited

U.S. PATENT DOCUMENTS 4,242,808 A 1/1981 Luthi ..... 34/23

FOREIGN PATENT DOCUMENTS

| | | |
|---|---|---|
| EP | 0 745 727 | 12/1996 |
| JP | 29-14922 | 11/1954 |
| JP | 35-9669 | 7/1960 |
| JP | 48-27604 | 8/1973 |
| JP | 53-18056 | 2/1978 |
| JP | 56-110870 | 9/1981 |
| JP | 60-4320 | 2/1985 |
| JP | 2-251700 | 10/1990 |
| JP | 9-119099 | 5/1997 |
| JP | 9-119100 | 5/1997 |
| JP | 9-316800 | 12/1997 |
| JP | 11-314267 | 11/1999 |

OTHER PUBLICATIONS

T. Goto, Public Relations Department, Kao Corporation, 4 pages, "Paper–Bottle Molding System", Oct. 25, 2000 (with English Translation).

*Primary Examiner*—Dean T. Nguyen
(74) *Attorney, Agent, or Firm*—Oblon, Spivak, McClelland, Maier & Neustadt, P.C.

(57) ABSTRACT

A method of producing a pulp molded article comprising a papermaking step in which a pulp slurry is fed to the surface of a papermaking mold having suction paths, and water contained in the pulp slurry is sucked through the suction paths whereby the pulp is deposited on the surface to form a wet preform, and a dewatering step in which the wet preform is dewatered, wherein the temperature of the fed pulp slurry is raised while the pulp is being deposited on the surface.

11 Claims, 4 Drawing Sheets

10
11
12
13
14
16
54

METHOD FOR PRODUCING PULP MOLDED ARTICLE

BACKGROUND OF THE INVENTION

The present invention relates to a method for producing pulp molded articles at improved efficiency in dewatering and drying. The invention also relates to a method for producing pulp molded articles in which a prescribed portion of a wet pulp preform has a controlled water content in the steps of dewatering and drying.

Known techniques of producing pulp molded articles include the method disclosed in Japanese Patent Laid-Open No. 9-119100, which comprises immersing a papermaking mold having suction paths in a tank filled with a high-temperature pulp slurry and sucking up the pulp slurry through the suction paths to form a pulp preform. The method aims at reduction of the time required in the following dewatering step.

However, where the pulp slurry has a high temperature from the start of feeding, cost for energy is incurred, and the resulting molded article is liable to suffer from wall thickness unevenness chiefly because the pulp slurry is so flowable that the flow is disarranged where the surface layer of a wet preform is to be formed. Further, additives such as a pigment and a sizing agent sometimes fail to produce the expected effects. In particular, a pigment tends to cause color unevenness on the outer surface of a molded article which is formed in the initial stage of pulp deposition.

Production of pulp molded articles includes a dewatering step in which a wet preform is dewatered so as to increase handling properties and to shorten the time of drying in the subsequent drying step. Known dewatering methods include pressing with an elastic member or a flexible film.

In the dewatering step by pressing, the pressing force has to be increased in order to sufficiently reduce the water content of a preform, so that meshes of papermaking net may be clogged with pulp to leave a net trace on the preform, which impairs the outer appearance of the article. Further, a larger apparatus is required to apply a higher pressing force. Furthermore, mechanical dewatering has of necessity a limit in reducing the water content. Much time would be required to obtain a satisfactorily reduced water content only by dewatering.

A method of drying a wet preform by steam heating is known as disclosed in Japanese Patent Laid-Open Nos. 53-18056, 60-4320 and 9-316800. The drying method relies on heat exchange by the heat energy of steam, which is not advantageous from the standpoint of energy efficiency.

Thickness unevenness also occurs between an upper area and a lower area of the article in case of elongated pulp molded articles because pulp fibers in a pulp slurry tend to go down by gravity according to conditions.

When a preform with such a thickness unevenness is dewatered, dewatering proceeds easily in thinner-walled portions, while dewatering proceeds with more difficulty in thicker-walled portions. As dewatering proceeds, the hydrogen bond among pulp fibers in the thinner-walled portions gets closer to gain shape retention and thus, the thinner-walled portions are hard to shape as designed due to the high shape retention in the case of drying while shaping into a desired shape in the subsequent heat drying step. On the other hand, the thicker-walled portions, which are less dewatered than the thinner-walled portions, need a longer time of drying, making it difficult to shorten the time for drying the whole article.

SUMMARY OF THE INVENTION

An object of the present invention is to provide a method of producing a pulp molded article in which wall thickness unevenness can be reduced while saving the cost of energy and without impairing the effects of additives.

Another object of the present invention is to provide a method of producing a pulp molded article in which a wet pulp preform can be dewatered and dried efficiently.

Still another object of the present invention is to provide a method for producing a pulp molded article in which the water content in a prescribed portion of a wet pulp preform in dewatering and drying can be controlled to secure shapability as designed in the step of heat drying.

Yet another object of the present invention is to provide a method of producing a pulp molded article in which a pulp preform is prevented from color change due to scorching in the step of heat drying.

The above objects are accomplished by a method of producing a pulp molded article comprising:

a papermaking step in which a pulp slurry is fed to the surface of a papermaking mold having suction paths, and water contained in the pulp slurry is sucked through the suction paths whereby the pulp is deposited on the surface to form a wet preform, and a dewatering step in which the wet preform is dewatering, wherein the temperature of the fed pulp slurry is raised while the pulp is being deposited on the surface.

The objects. of the present invention are also accomplished by a method for producing a pulp molded article comprising:

a papermaking step in which a pulp slurry is fed into the cavity of a papermaking mold, and the cavity is evacuated toward the outer side of the papermaking mold to form a wet pulp preform on the inner wall of the mold, and a dewatering step in which a dewatering fluid is blown into the cavity in a closed state to dewater the preform, wherein the dewatering fluid is superheated steam, and the steam is blown in such a manner that the pressure in the cavity increases to 98 kPa[gauge] or higher, or the dewatering fluid is heated or non-heated compressed air, and the air is blown in such a manner that the pressure in the cavity increases to 196 kPa[gauge] or higher.

BRIEF DESCRIPTION OF THE DRAWINGS

The present invention will be more particularly described with reference to the accompanying drawings, in which:

FIG. 4A and FIG. 4B schematically show the steps of papermaking and dewatering, sequentially, in still another embodiment of the method of the invention, wherein FIG. 4A is the step of feeding a pulp slurry to make a preform; and FIG. 4B is the step of feeding a dewatering fluid to dewater the preform.

DETAILED DESCRIPTION OF THE PREFERRED EMBODIMENTS

Figure 1:
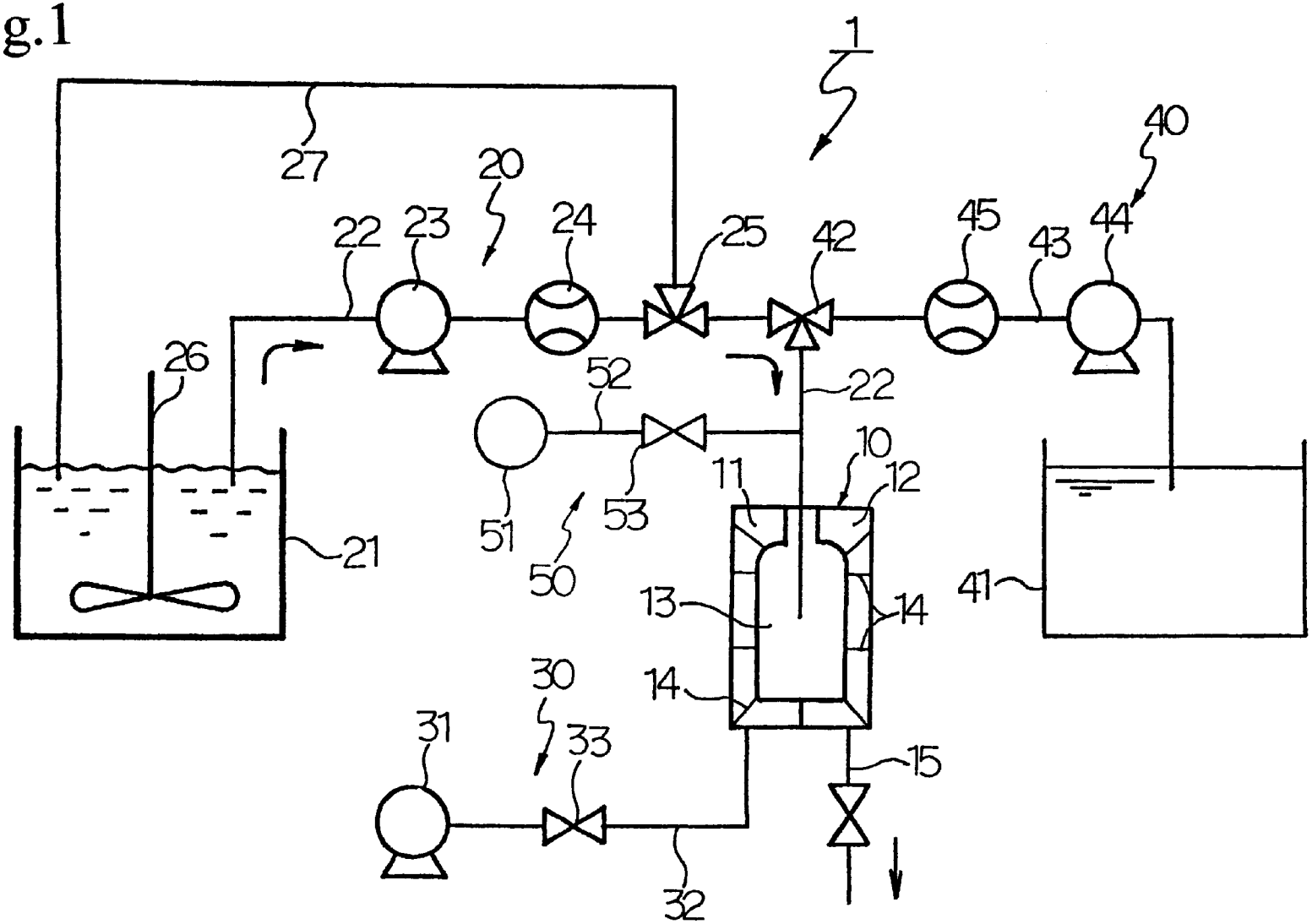
FIG. 1 is a schematic illustration of an apparatus which can be used to carry out an embodiment of the method of the invention.

The present invention will be described based on its preferred embodiments by referring to the accompanying drawings. FIG. 1 is a schematic illustration of an apparatus 1 which can be used to carry out one embodiment of the invention.

The apparatus 1 has, as a main part, a reciprocating mold clamping mechanism (not shown), in which a pair of splits 11 and 12 are oppositely arranged and moved horizontally for engagement to form a split mold 10 having a cavity 13 with an opening at the top. The apparatus 1 also has a pulp slurry feeding means 20 for feeding a pulp slurry to the papermaking surface of the mold 10 (inner side of a papermaking net), a suction means 30 for sucking the water content of the pulp slurry fed to the cavity 13 by the feeding means 20 to form a wet preform, a temperature raising means 40 for raising the temperature of the fed pulp slurry, and a dewatering means 50 for dewatering the wet preform.

The splits 11 and 12 making the mold 10 each have suction paths 14 through their inside. The mold 10 has a drain pipe 15 for discharging the water content of the pulp slurry drained outside the cavity 13. The inner wall of each of the splits 11 and 12 is covered with a papermaking net (not shown).

The papermaking net can be made of natural fiber, synthetic fiber or metallic fiber. A plurality of such nets may be used in combination. A net made of different kinds of the fiber may also be used. Synthetic fiber is preferred for ease of net making and for durability. Useful natural fiber includes plant fiber and animal fiber. The synthetic fiber includes synthetic resin fibers, such as thermoplastic resin fiber, thermosetting resin fibers, and semi-synthetic resin fiber. The metallic fiber includes stainless steel fiber and copper fiber. The surface of fibers making up the net is preferably modified so as to have improved slipping properties and durability.

The papermaking net preferably has an average opening area ratio of 10 to 70%, particularly 25 to 55%, to prevent adhesion to the inner wall of the splits and maintain satisfactory suction efficiency. The papermaking net preferably has an average maximum opening width of 0.1 to 1.5 mm, particularly 0.3 to 1.0 mm, so as to prevent pulp fibers from passing through the net or to prevent the net from clogging while papermaking without fail.

The pulp slurry feeding means 20 has a slurry tank 21 for containing a pulp slurry having a prescribed concentration at a prescribed temperature, a feed pipe 22 for delivering the pulp slurry from the slurry tank 21 into the opening of the cavity 13, a feed pump 23 provided in the feed pipe 22, a flow meter 24 for measuring the flow rate of the pulp slurry, and a three-way valve 25. The slurry tank 21, the feed pump 23, the flow meter 24, and the three-way valve 25 are connected in series. The slurry tank 21 is equipped with a stirrer 26. To the three-way valve 25 is connected a return pipe 27 for returning the pulp slurry to the slurry tank 21. The three-way valve 25 is operated based on the output of the flow meter 24 so that the flow path of the pulp slurry may be switched between the direction to the mold 10 and the direction to the slurry tank 21.

The suction means 30 has a suction pump 31, a suction pipe 32 connecting the suction pipe 31 and the suction paths 14 of the splits 11 and 12, and a shut-off valve 33 provided in the suction pipe 32.

The temperature raising means 40 has a warm water tank 41 containing warm water at a prescribed temperature (fluid for temperature rise), a warm water feed pipe 43 connecting the warm water tank 41 and the feed pipe 22 via a three-way valve 42, a feed pump 44, and a flow meter 45. The three-way valve 42 enables feeding only the pulp slurry from the slurry tank 21, feeding only the warm water from the warm water tank 41, or both of these feedings simultaneously.

The dewatering means 50 has a feeder 51 which supplies a dewatering fluid to the cavity 13, a feed pipe 52 connecting the feeder 51 and the feed pipe 22, a shut-off valve 53 provided in the feed pipe 52, and a pressing member 54 (hereinafter described with reference to FIGS. 2B to 2D).

The method of producing a pulp molded article by use of the apparatus 1 shown in FIG. 1 will be described with reference to FIGS. 2A to 2D. The feed pump 23 is operated to suck up the pulp slurry from the slurry tank 21 and inject it into the inside of the cavity 13 of the mold 10 under pressure through the flow meter 24 and the three-way valves 25 and 42 as shown in FIG. 2A.

The pressure of the pulp slurry at the end of the injection is preferably 0.01 to 1.0 MPa, still preferably 0.1 to 0.5 MPa. In order to prevent wall thickness unevenness and reduction of the additives' effects, the temperature of the pulp slurry fed into the inside of the cavity is preferably 5 to 35° C., still preferably 15 to 30° C.

The pulp slurry which can be used comprises water and conventional pulp fiber. The pulp slurry can contain additives, such as inorganic pigments, e.g., titanium oxide, zinc oxide, carbon black, chrome yellow pigments, red iron oxide, ultramarine, and chromium oxide; and organic pigments, e.g., phthalocyanine pigments, azo pigments, and condensed polycyclic pigments. These additives are preferably added in an amount of 0.01 to 10% by weight, particularly 0.2 to 2% by weight, based on the pulp slurry. The pulp slurry can further contain inorganic substances such as talc and kaolinite, inorganic fiber such as glass fiber and carbon fiber, particulate or fibrous thermoplastic resins such as polyolefins, non-wood or plant fiber, and polysaccharides. The proportion of these components are preferably 1 to 90% by weight, particularly 5 to 70% by weight, based on the total amount of the pulp fiber and these components.

The water content of the pulp slurry injected into the inside of the cavity 13 is discharged out of the mold 10 through the suction paths 14 and. the drain pipe 15. The feed of the pulp slurry being larger than the discharged water content, the cavity 13 is gradually filled with the pulp slurry. When a sufficient amount of the pulp slurry to deposit the pulp is injected, the shut-off valve 33 of the suction pipe 32 is opened, and the suction pump 31 is operated to carry out the evacuation of the inside of the cavity 13 through the suction paths 14 of the mold 10 and the suction pipe 32. Thus the water content of the pulp slurry is discharged, and the pulp is deposited in the inner side of the papermaking net to form a wet pulp preform 16 comprising a pulp layer.

On completing injection of a prescribed amount of the pulp slurry, the three-way valve 25 is switched based on the output of the flow meter 24, and the pulp slurry is returned to the tank 21 through the return pipe 27. Meantime the warm water is sucked up from the warm water tank 41 by means of the feed pump 44 and injected into the cavity 13 under pressure through the flow meter 45 and the three-way valve 42.

The pressure of the warm water at the end of injection is preferably 0.01 to 1.0 MPa, still preferably 0.1 to 0.5 MPa. For effectively elevating the slurry temperature in the cavity to a desired temperature, the temperature of the warm water is preferably 35 to 95° C., still preferably 45 to 80° C.

Since both the pulp slurry and the warm water are injected under pressure to apply a prescribed pressure to the inside of the cavity 13, the slurry pressure is almost equal at every part of the wall of the cavity 13 thereby to build up pulp on the papermaking surface substantially uniformly.

The ratio of the pulp slurry feed and the warm water feed is decided appropriately according to the temperatures of the pulp slurry and the warm water, the desired slurry temperature inside the cavity, the shape and size of the molded article (the cavity volume), the additives in the pulp slurry, and the like.

In the present invention, the temperature of the pulp slurry inside the cavity is raised while the pulp is being deposited. In order to prevent wall thickness unevenness and impairment of the additives' effects, the pulp slurry temperature inside the cavity at the beginning of pulp deposition is preferably 5 to 35° C., still preferably 15 to 30° C. In order to improve dewatering efficiency and prevent thickness unevenness and impairment of the additives' effects, the pulp slurry temperature inside the cavity at the end of the pulp deposition is preferably 35 to 95° C., still preferably 45 to 80° C. On completing warm water injection, the shut-off valve 53 (FIG. 1) is opened to feed a dewatering fluid from the feeder 51 into the inside of the cavity 13 through the feed pipe 52 to carry out dewatering. Room temperature compressed air is used as a dewatering fluid for its handling properties.

Figures 2A, 2B, 2C, 2D:
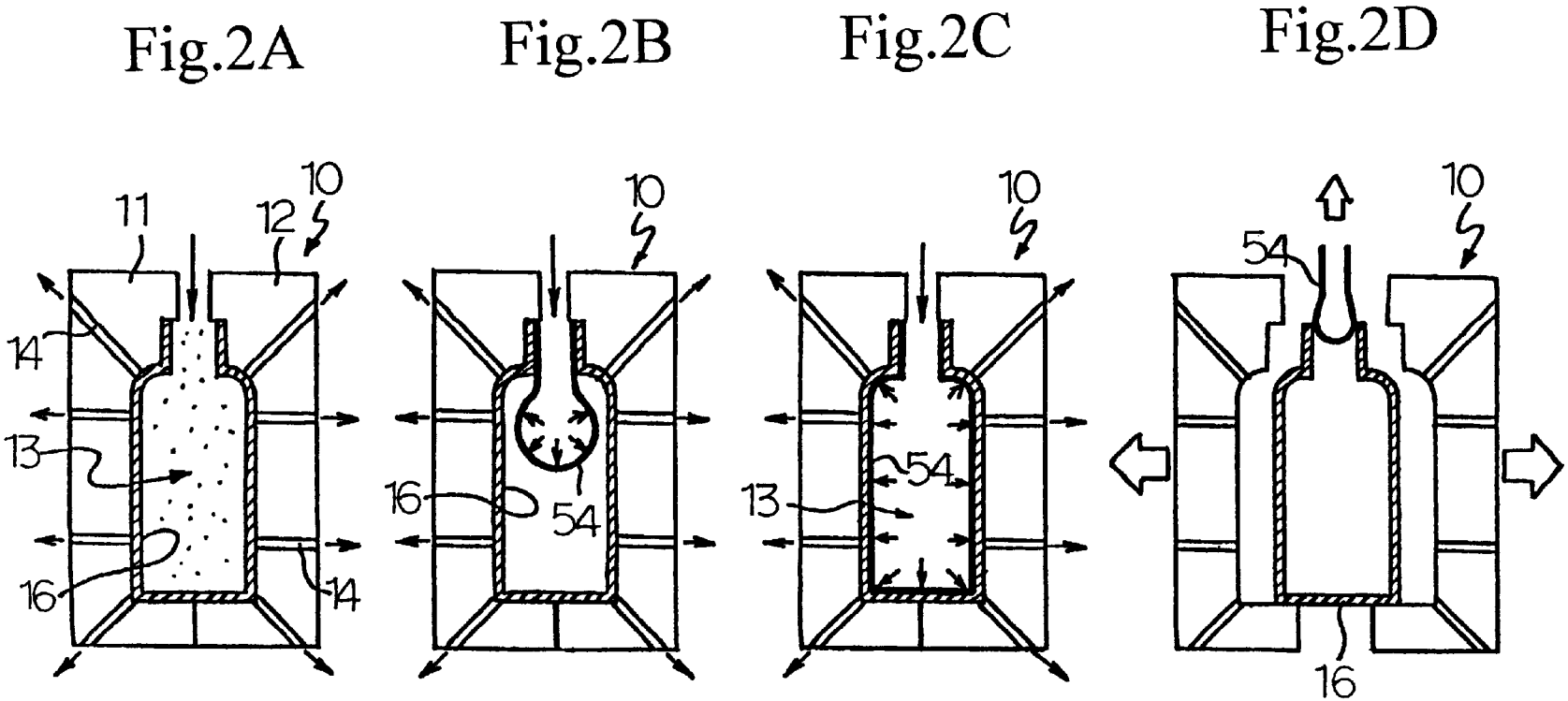
FIG. 2A, FIG. 2B, FIG. 2C, and FIG. 2D schematically show an embodiment of the method of the invention.

After dewatering with a dewatering fluid, an inflatable hollow pressing member 54 is inserted into the cavity 13 while evacuating the cavity 13 by suction through the suction paths 14 as shown in FIG. 2B. The pressing member 54 is to be inflated inside the cavity 13 like a balloon to press the wet preform 16 comprising a pulp layer onto the inner wall of the cavity 13 thereby to transfer the inner wall configuration of the cavity 13 to the preform 16. The term "inflatable" as used herein is intended to mean that (1) the pressing member 54 elastically stretches to change its capacity or (2) the pressing member 54 itself is not stretchable but is flexible so that it is capable of changing its capacity with a fluid fed inside or discharged. The former inflatable pressing member can be of an elastic material, such as urethane rubber, fluororubber, silicone rubber and elastomers. The latter inflatable pressing member can be made of flexible materials, such as a plastic film (e.g., polyethylene and polypropylene), a plastic film having aluminum or silica deposited thereon, a plastic film having aluminum foil laminated thereon, paper and fabric. In this embodiment, a balloon-like bag made of a stretchable elastic material is used as the pressing member 54.

As shown in FIG. 2C, a pressurizing fluid is fed into the pressing member 54 to inflate the pressing member 54. The inflated pressing member 54 presses the pulp preform onto the wall of the cavity 13 whereby the inner wall configuration of the cavity 13 is transferred to the outer surface of the preform and, at the same time, dewatering proceeds further. Since the preform 16 is pressed from the inside of the cavity 13 toward the wall of the cavity 13, the configuration of the cavity 13 can be transferred to the preform with good precision however complicated it may be. Unlike a conventional pulp molded article obtained by joining separately prepared molded parts, the molded article of the present invention is free from seams or thickness unevenness due to joining and therefore has higher strength and improved appearance. The pressuring fluid used to inflate the pressing member 54 includes compressed air (or heated compressed air), oil (or heated oil), and other liquids. The pressure far feeding the pressurizing fluid is preferably 0.01 to 5 MPa, still preferably 0.1 to 3 MPa.

After the configuration of the inner wall of the cavity 13 is sufficiently transferred to the preform 16, and the preform is dewatered to a prescribed water content, the pressurizing fluid is withdrawn from the pressing member 54, whereupon the pressing member 54 shrinks spontaneously to its original size. The shrunken pressing member 54 is taken out of the cavity 13, and the mold 10 is opened to take out the wet preform 16 having the prescribed water content as shown in FIG. 2D.

The wet preform 16 is then heat dried. The step of heat drying is carried out in the same manner as in the step of dewatering depicted in FIGS. 2B to 2D, expect that papermaking and dewatering are not carried out. That is, a pair of splits are butted to form a drying mold whose cavity corresponds to the contour of a final pulp molded article, the drying mold is heated to a prescribed temperature, and the wet preform is set in the drying mold.

The same pressing member as used in the dewatering step is inserted into the preform, a pressurizing fluid is fed into the pressing member to inflate the pressing member, with which to press the preform onto the cavity wall. The material of the pressing member and the feeding pressure of the pressurizing fluid can be the same as in the dewatering step. While being pressed, the preform is dried by heating. On sufficiently drying, the pressurizing fluid is withdrawn from the pressing member, and the shrunken pressing member is taken out. The drying mold is opened to take out the dried molded article.

According to the above-described embodiment, the pulp slurry inside the cavity is allowed to increase its temperature while the pulp is being deposited. This leads to the following advantages. The energy cost for the temperature elevation can be reduced. Because the flowability of the pulp slurry is not high in the beginning of deposition, unevenness in deposit thickness can be reduced. The effects of the additives added to the pulp slurry are not impaired. Since t he pulp slurry in the cavity as well as the deposited pulp increase the temperature to reduce the viscosity of water, which increases dewatering efficiency and reduces the production time.

The resulting pulp molded article is free from thickness un evenness and enjoys sufficient effects of the additives. Where a pigment is used, in particular, a highly decorative pulp molded article with no color unevenness on the outer surface can be obtained. The pulp molded articles obtained by this embodiment are cylindrical bottle containers whose opening is smaller in diameter than the body, which are particularly fit for keeping powder or granules. There are no seams in any area of the opening, the body and the bottom of the molded article, and the opening, the body and the bottom of the molded article are made integral, which assures strength and satisfactory appearance.

While in the above-mentioned embodiment the pulp slurry and the warm water are supplied through the feed pipe 22, they may be fed through the respective lines.

The feed of warm water for raising the temperature of the pulp slurry within the cavity may be commenced simultaneously with or after the start of the feed of the pulp slurry to the cavity.

After completion of the pulp deposition and before feeding the dewatering fluid, warm water can be fed into the cavity to raise the temperature of the wet preform thereby to improve the dewatering efficiency in the subsequent dewatering step. The temperature of the warm water to be fed can be set appropriately. From the standpoint of the temperature of the preform, dewatering efficiency and handling properties, a temperature of 40 to 90° C., particularly 50 to 80° C., is preferred. The warm water can be injected under pressure. The injection pressure can be the same as used in injecting the warm water used for raising the temperature of the pulp slurry while being deposited.

The means for raising the temperature of the pulp slurry while the pulp is being deposited is not restricted. For example, the warm water as used in the above-described embodiment may be replaced with a warm pulp slurry whose temperature is in the same range as for the warm water and whose composition may be the same as or different from the pulp slurry previously fed into the cavity. In case where a warm pulp slurry having a different composition is used, there is obtained a multilayered preform. In this case, it is preferred that the pulp slurry having a different composition be fed from another pulp slurry tank after a wet preform is once formed of the pulp slurry fed from the pulp slurry tank 21. It is also effective to use, in place of the warm water, steam, superheated steam or heated compressed air to elevate the temperature of the pulp slurry in the cavity. Further, the cavity may be fitted with a heating means (i.e., a heater) to raise the temperature of the pulp slurry in the cavity. From the standpoint of temperature elevation efficiency, the fluid is preferred to the heater. The fluid for temperature elevation is preferably warm water or steam in light of the heat capacity.

While the embodiment is suitable to the system in which the pulp slurry is injected into a papermaking mold made of splits having suction paths from an opining located at the top thereof, it is also applicable to the system in which the papermaking mold is dipped in a pulp slurry tank to let the pulp slurry in. It is also suitable to the system comprising a cavity block in a split form having suction paths, and a frame enclosing at least the papermaking surface of the cavity block. The cavity block is placed with its papermaking surface up and the frame is liquid-tightly arranged to form a cavity to be filled with a pulp slurry. Then, a prescribed amount of a pulp slurry is fed into the cavity and the pulp slurry is sucked through the suction paths to form a wet preform on the papermaking surface.

While in the present embodiment dewatering by feeding room temperature compressed air is followed by dewatering with a pressing member, either one of dewatering with room temperature compressed air or dewatering with a pressing member will do. The room temperature compressed air can be replaced with heated compressed air, steam or superheated steam.

The pulp deposition can be followed by dewatering by opening the shut-off valve 53 shown in FIG. 1 and feeding dewatering fluid from the feeder 51 through the feed pipe 52 into the cavity 13. From the standpoint of production cost and handling properties, superheated steam or heated or non-heated compressed air is preferably used as a dewatering fluid.

In using superheated steam as a dewatering fluid, it is preferably blown to increase the cavity pressure to 98 kPa[gauge] or higher. In using heated or non-heated compressed air as a dewatering fluid, it is preferably blown to increase the cavity pressure to 196 kPa[gauge] or higher, particularly 294 kPa[gauge] or higher. Under such a condition a physical mechanism which does not chiefly rely on heat drying by heat exchange works to instantaneously remove the water content from the wet preform and achieve dewatering in a reduced time. The term "pressure in the cavity" or simply "cavity pressure" as used herein means a difference between the inlet pressure and the outlet pressure of the room temperature compressed air into the inside of the cavity. The dewatering of the preform 16 by using the dewatering fluid will be described in the following paragraphs in greater detail with reference to the embodiment shown in FIG. 3.

Figure 3:
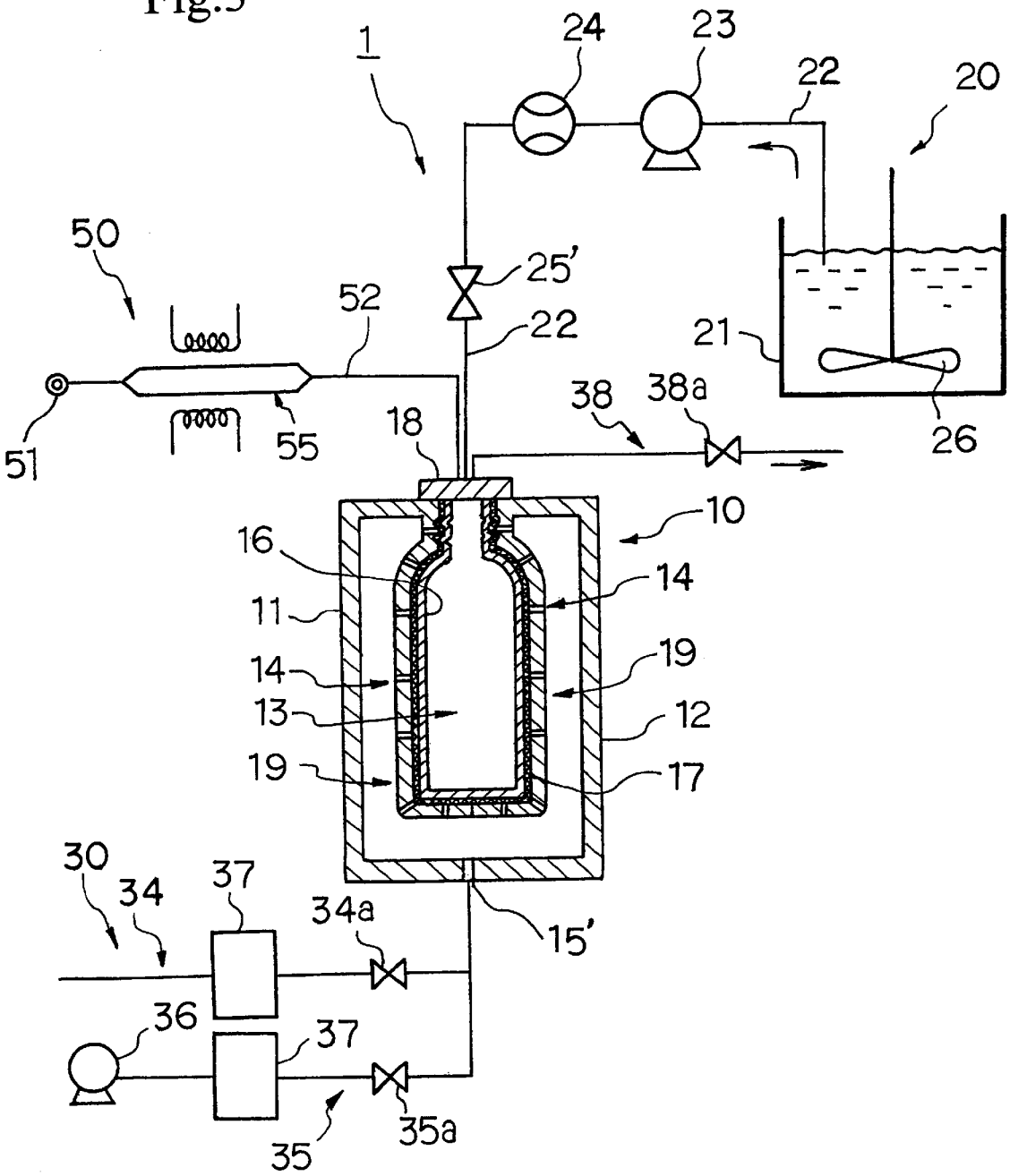
FIG. 3 schematically shows an apparatus which can be used to carry out another embodiment of the method of the invention.

FIG. 3 shows another embodiment of the present invention. Only the particulars different from the first embodiment shown in FIG. 1 and FIGS. 2A to 2D will be described. The description about the first embodiment appropriately applies to the particulars that are not explained here. The members in FIG. 3 which are the same as those in FIG. 1 and FIGS. 2A to 2D are given the same numerical references.

The apparatus 1 used in this embodiment has a pulp slurry feeding means 20, a suction means 30, and a dewatering means 50.

The pulp slurry feeding means 20 is the same as the one shown in FIG. 1, except that, in the feeding means 20 shown in FIG. 3, the return pipe 27 is not provided, and the three-way valve 25 is replaced with an shut-off valve 25'. If desired, the feeding means 20 may have a return pipe.

A mold 10 is made of a pair of splits 11 and 12. When butted together, the splits 11 and 12 form a cavity 13 of prescribed shape inside the mold 10. A number of grooves (not shown) are provided on the inner wall of the cavity 13, which lead to the outside of the mold 10. The grooves are to allow a dewatering fluid (superheated steam, or compressed air or heated compressed air; hereinafter described) to sufficiently distribute and condensed water to rapidly discharge in case of using superheated steam as a dewatering fluid. The cavity 13 is covered with a papermaking net 17 having a prescribed mesh. The cavity 13 has a mouth open to the air, which is closed by a closure plate 18. The pulp slurry and the dewatering fluid are fed into the cavity 13 through the hole bored in the closure plate 18.

Each split 11 or 12 has a hollow manifold 19 inside thereof The cavity 14 has, in its the inner wall, a plurality of suction paths leading to the manifold 19. The mold 10 has, in its outer wall, a throughhole 15' leading to the manifold 19. There is thus formed a path leading the inside to the outside of the mold 10, interconnecting the cavity 13, the suction paths 14, the manifold 19, and the throughhole 15'.

The dewatering means 50 has a dewatering fluid feeder 51, a feed pipe 52 for feeding the dewatering fluid from the feeder 51 to the cavity 13, and a heat exchanger 55 for heating the dewatering fluid provided on the feed pipe 52. A pressure control vale (not shown) is provided between the feeder 51 and the heat exchanger 55 so as to control the pressure of the dewatering fluid blown into the cavity 13. The feed pipe 52 is maintained or heated at a certain temperature to prevent the temperature of dewatering fluid from lowering. Where non-heated compressed air is used as a dewatering fluid, the heat exchanger 55 is not necessary.

The suction means 30 has an evacuation line 34 and a drain line 35. Each line leads to the throughhole 15' of the mold 10. Shut-off values 34*a* and 35*a* are provided on the evacuation line 34 and the drain line 35, respectively. The end of the drain line 35 is connected to a suction pump 36. Where necessary, a water separator 37 is provided between the suction pump 36 and the shut-off valve 35*a*. To the closure plate 18, which closes the opening of the mold 10, is connected a second evacuation line 38, which has a shut-off value 38*a*.

Production of pulp molded articles by use of the apparatus 1 according to this embodiment proceeds in the same manner as in the first embodiment up to the formation of a pulp deposited wet preform 16, i.e., a wet preform 16.

On feeding a prescribed amount of the pulp slurry to the cavity 13, the feed pump 23 is stopped, and the shut-off valve 25' is shut. Then a dewatering fluid is blown from the feeder 51 into the cavity 13 in a closed state from the upper opening of the mold 10. The cavity 13 in the closed state does not need to be completely airtight but should have such air-tightness that the pressure in the cavity 13 may reach a certain pressure hereinafter defined. During the feed of the dewatering fluid, the shut-off valve 34*a* of the evacuation line 34 is opened, while the shut-off value 38*a* of the second evacuation line 38 is closed, and the shut-off valve 35*a* is also closed. The dewatering fluid passes through the wet preform 16 and discharged through the evacuation line 34 via the suction paths 14, the manifold 19 and the through-hole 15'. Where superheated steam is used as a dewatering fluid, it is likely that condensed water adheres to the inner wall of the mold 10, which is rapidly led outside the mold 10 through the above-mentioned grooves. The condensed water is separated in the water separator 37.

The dewatering fluid used here is superheated steam, non-heated compressed air or heated compressed air (the term "compressed air" will be used to mean both the heated and non-heated compressed air unless otherwise noted). In using superheated steam as a dewatering fluid, it is blown to increase the pressure in the cavity to 98 kPa[gauge] or higher, preferably196 kPa[gauge] or higher, still preferably 294 kPa[gauge] or higher. In using compressed air as a dewatering fluid, it is blown to increase the cavity pressure to 196 kPa[gauge] or higher, preferably 294 kPa[gauge] or higher. Under such a condition a physical mechanism which does not chiefly rely on heat drying by heat exchange works to instantaneously remove the water content from the wet preform 16. In particular where superheated steam is employed, the temperature of the preform instantaneously reaches the generally saturated vapor temperature by heat transfer in condensation of superheated steam. As a result, the water content present in the wet preform reduces its surface tension and viscosity and is thereby instantaneously blown off very efficiently. Not mainly based on heat-exchange, this dewatering method is extremely advantageous from the standpoint of energy consumption. Since dewatering completes in a moment, the time of dewatering is shortened. Not using a pressing member as used in the heat drying step, the time for mechanical operation of inserting and withdrawing the pressing member is not involved, shortening mechanical working time. Further, because the blowing pressure is lower than the pressure in press dewatering with the pressing member, the preform hardly gets the mark of the papermaking net, which assures a satisfactory appearance. As stated previously, the "pressure in the cavity 13" is the difference in pressure of superheated steam or compressed air between the inlet and the outlet of the cavity 13.

The pressure in the cavity 13 created by the dewatering fluid is preferably as high as possible exceeding the above-specified value. However, because the rate of dewatering gradually approaches a saturation with an increase in blowing pressure, the upper limit of the cavity pressure which is consistent with economy would be about 980 kPa as for superheated steam and about 1471 kPa as for compressed air.

The instantaneous dewatering of the preform 16 by superheated steam or compressed air completes when the cavity pressure becomes stationary. The cavity pressure is decided by the feeding pressure and the feeding rate of the dewatering fluid and the air permeability of the wet preform 16. Therefore, where the wet preform 16 has low air permeability, and the dewatering fluid is fed at a high rate, the cavity pressure rises in a moment, and dewatering completes instantaneously. Where, on the other hand, the deposited pulp layer has low air permeability, and the dewatering fluid feeding rate is low, the rise in cavity pressure is slow, and the time required for dewatering is long. In general, dewatering completes in an extremely short time as about 0.1 to 10 seconds, particularly about 1 to 5 seconds. By this dewatering step, a wet preform having a water content of 75 to 80% by weight is dewatered to reduce its water content to about 40 to 60% by weight.

In using superheated steam as a means for instantaneous dewatering, the degree of superheating of the superheated steam is such that the pressure in the cavity may be increased to at least the above-specified pressure and that the steam may not be condensed before it is introduced into the cavity. Steam can be superheated to a higher degree but the dewatering effect is not so increased. In using compressed air as a means for instantaneous dewatering, the feeding pressure is not particularly limited as long as the cavity pressure can reach the above-specified pressure. Whether or not the compressed air is heated, which is not particularly limited, is not so greatly influential on the dewatering effect.

Where superheated steam or heated compressed air is used, after the water content of the wet preform 16 is reduced to a prescribed level (after completion of dewatering), the shut-off valve 38*a* of the second evacuation line 38 is opened while continuing the blowing whereby a part or the whole of the superheated steam or heated compressed air blown into the cavity 13 is discharged through the second evacuation line 38 leading to an opening of the mold 10 which is the inlet of the blowing. Where non-heated compressed air is used, the feed is stopped on completion of dewatering. At the same time, blowing path is switched, and heated compressed air is blown into the cavity from a feed source not shown, and a part or the whole of the heated compressed air is discharged through the second evacuation line 38. Where the preform 16 has a high water content, the air permeability is so low that the heat exchange by superheated steam or heated compressed air tends to be insufficient. Even in such a case, the superheated steam or heated compressed air with a part or the whole of which being discharged can be circulated in the cavity 13 to induce heat exchange with the inner surface of the preform 16 thereby to heat and dry that surface. As a result, the drying efficiency is improved, and there is produced a water content gradation in the thickness direction of the preform 16. Specifically, the water content gradually increases from the inner surface to the outer surface of the preform 16. In other words, the water content of the preform 16. is the lowest in the inner surface and the highest in the outer surface. It is preferable for the preform 16 to have such a water content gradation in order for the configuration of a drying mold to be transferred faithfully to the preform 16 in the subsequent heat drying step hereinafter described, that is, for improving transfer precision.

The time for continuing blowing superheated steam or heated compressed air after the instantaneous dewatering or the time for discharging a part or the whole of the blown superheated steam or heated compressed air depends on the surface properties and shapability of the wet preform 16 and the efficiency of heat drying in the subsequent drying step. Where the degree of dewatering is higher, the time required for drying is shorter, but surface properties and shapability in the heat drying step reduces because the outer surface of the preform has a lower water content.

The flow rate and temperature of the superheated steam or heated compressed air to be used for heat drying after the instantaneous dewatering are selected appropriately taking the drying efficiency and decoloration of the pulp into consideration.

The preform 16 taken out of the mold 10 is then set in a drying mold to be heat-dried. The step of heat drying is carried out in the same manner as in the first embodiment shown in FIGS. 2B to 2D. In this embodiment, the wet preform to be dried has a water content gradually increasing in the thickness direction from the inner side toward the outer side which has the highest water content. That is, the pulp fibers on the outer surface and in the vicinities thereof have relatively high freedom, which allows the configuration of the cavity to be transferred to the preform 16 with high precision while the preform 16 is pressed by the pressing member. Since the inner surface and its vicinities of the preform 16 have been dewatered sufficiently in the preceding dewatering step, improved drying efficiency can be secured.

The wet preform 16 as it is in the papermaking mold can be subjected to heat drying by using the above-described pressing member while heating the papermaking mold.

In case where the instantaneous dewatering is followed by heat drying with the heated dewatering fluid (i.e., superheated steam or heated compressed air), the temperature of the fluid in the instantaneous dewatering and that in the heat drying do not always need to be different. Sufficiently superheated steam can be used for the instantaneous dewatering. It is possible to use superheated steam for the instantaneous dewatering and compressed air for the heat drying, or to use heated or non-heated compressed air for the instantaneous dewatering and superheated steam for the heat drying.

It is also possible that the heat drying step is not conducted but, instead, the dewatering step is carried out by using a heated fluid (i.e., superheated steam or heated compressed air) to dry the wet preform 16 to the final water content as contemplated in the heat drying step. In this case, evacuation of a part or the whole of the heated fluid is continued until the drying of the preform 16 completes.

While in the above-described embodiment the papermaking and the dewatering were carried out in the papermaking mold 10, the preform 16 may be once removed from the papermaking mold 10 after papermaking and dewatered in a separately prepared dewatering mold.

A modification of the second embodiment shown in FIG. 3 (hereinafter referred to as a third embodiment) will be explained in accordance with FIGS. 4A and 4B. Similarly to the foregoing embodiments, the third embodiment is to produce pulp molded bottle containers having an opening (neck) whose diameter is smaller than the diameter of the body.

Figure 4A:
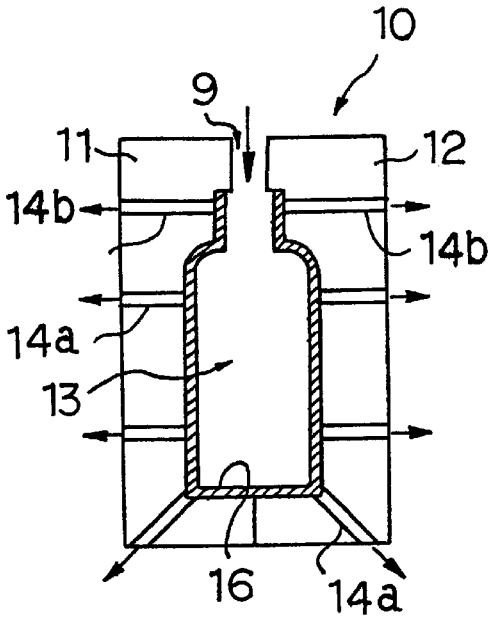

As shown in FIG. 4A, each of splits 11 and 12 forming a papermaking mold 10 has a plurality of first suction paths 14*a* in the portions corresponding to the body and the bottom of a molded article and a plurality of second suction paths 14*b* in the portion corresponding to the neck. Each of these suction paths 14*a* and 14*b* interconnects the inside and the outside of the mold 10. The first suction paths 14*a* lead to a suction means such as a suction pump (not shown), while the second suction paths 14*b* are connected alternately to a suction means such as a suction pump (not shown) and a second fluid feeder (not shown) through a three-way valve, etc. At the start of pulp deposition, the second suction paths 14b lead to the suction means.

A prescribed amount of the pulp slurry is injected into the cavity 13 through a gate 9 as shown in FIG. 4A while evacuating the slurry in cavity 13 through the first suction paths 14*a* and the second suction paths 14*b* toward the outside of the mold 10. The water content of the pulp slurry in the cavity is thus sucked to deposit the pulp fibers on the papermaking side of the mold 10, i.e., on the papermaking net covering the inner wall of the cavity 13, to form a wet preform 16.

The wet preform 16 will then be dewatered. The second suction paths 14*b* are connected to the second fluid feeder (not shown), and a dewatering fluid is fed into the preform 16 through the gate 9 as shown in FIG. 4B. The dewatering fluid fed into the preform 16 penetrates through the preform 16 and is discharged from the first suction paths 14*a* to the outside of the mold. At the same time, a second fluid is blown against the neck of the preform 16 from the outside of the mold through the second suction paths 14*b*. The term "path" as in the first suction paths 14*a* and the second suction paths 14*b* means a site where the dewatering fluid fed into the preform 16 has penetrated through the preform 16 and which lead to the outside of the mold. Since the second fluid is blown into the second suction paths 14*b* against the dewatering fluid, the pressure of the dewatering fluid flowing in the second suction paths 14*b* differs from that flowing in the first suction paths 14*a*. Therefore, the pressure difference $\Delta P_1$ between the dewatering fluid supply pressure $P_S$ and the discharge pressure $P_{D1}$ in the first suction paths 14*a* differs from the pressure difference $\Delta P_2$ between the supply pressure $P_S$ and the discharge pressure $P_{D2}$ in the second suction paths 14*b*. The amount of the dewatering fluid passing through the neck of the preform 16 is smaller than that through the other portions of the preform 16 on account of the difference between $\Delta P_1$ and $\Delta P_2$.

When a preform is produced upright with its neck up as in the case shown, the neck is apt to become relatively thinner than the other portions (the bottom and the body), particularly the bottom. If a preform having the relatively thinner neck portion and the other thicker portions are dewatered under equal conditions, the neck portion would be dewatered to a higher degree than the other portions so that the resulting dewatered preform will have a non-uniform water content distribution. According to the third embodiment of FIGS. 4A and 4B, the amount of the dewatering fluid passing through the neck can be suppressed in relation to that passing through the other portions by blowing the second fluid against the neck to control the pressure differences $\Delta P_1$ and $\Delta P_2$. The degree of dewatering in the neck portion is thus controlled in relation to that in the other portions. Because the amount of the dewatering fluid passing through the neck portion is reduced, that passing through the other portions of the preform 16 increases relatively to accelerate the dewatering in these portions. As a result, the preform 16 as a whole acquires a uniform water content distribution.

Thus the method according to the third embodiment comprises feeding a pulp slurry to a papermaking mold 10, depositing pulp fibers on the papermaking surface of the mold 10 to form a wet preform 16, and dewatering the wet preform 16 by feeding a dewatering fluid into the preform 16 and discharging the fluid through the preform 16 out of the mold 10, wherein the above-identified pressure differences $\Delta P_1$ and $\Delta P_2$ are so controlled that the amount of the dewatering fluid passing through a relatively thinner portion of the preform 16 may be made smaller than that passing through a relatively thicker portion of the preform 16.

The dewatering fluid is selected from those previously described so as to give the above-specified pressure. The second fluid includes steam, superheated steam, air, air containing water droplets, and steam containing water droplets. Air containing water droplets or steam containing water droplets are more effective in suppressing dewatering in the neck portion because it furnishes a water content to the neck.

The blowing pressure of the second fluid is adjustable according to the thickness of the neck, the desired degree of dewatering, and the like. It is about the same as or within 40% higher or lower than the supply pressure of the dewatering fluid. Where the blowing pressure of the second fluid is lower than the dewatering fluid supply pressure, the dewatering fluid is discharged out of the mold through the second suction paths 14*b,* but the amount of the discharged fluid is smaller than that that discharged through the first suction paths 14*a.* Where the blowing pressure of the second fluid is equal to or higher than the dewatering fluid supply pressure, the dewatering fluid is not discharged through the second suction paths 14*b.* The second fluid blowing pressure should be adjusted appropriately because too high a blowing pressure may cause surface roughness or boring of the preform 16. Anyway, the amount of the dewatering fluid passing through the neck portion (i.e., the relatively thinner portion) of the preform 16 can be made smaller than that passing through the other portions (i.e., the relatively thicker portions).

On dewatering the preform 16 to a prescribed water content, the mold 10 is opened to taken out the preform 16, which is then subjected to the same operations as described with respect to FIG. 3. Since the preform 16 has been dewatered almost uniformly, that is, the water content of the neck is not extremely small, the pulp fibers in the neck still possess sufficient freedom for allowing the configuration of the drying mold to be transferred thereto with good precision. This is advantageous in forming, for example, screw threads around the neck. Further, the preform 16 having been dewatered almost uniformly, the time required for drying can be shortened.

The portion where the amount of the dewatering fluid passing through is to be controlled is not limited to the neck. Any desired portion can be under such control according to the shape or the purpose of the molded article. For example, where the bottom of a preform 16 is rate-determining, the discharge of the dewatering fluid can be concentrated in the bottom to accelerate dewatering of the bottom by blowing the second fluid through both the first suction paths 14*a* around the body and the second suction paths 14*b* around the neck to suppress passage of the dewatering fluid therethrough and thereby to suppress dewatering in these portions.

In case where unevenness on the inner wall of the cavity corresponding to letters or patterns are transferred to a part (e.g., the body) of the preform 16, it is preferred to reduce the passage of the dewatering fluid through that part as compared with the other portions.

Where a preform 16 has a curved surface of small radius at the shoulder, etc., it is preferred to suppress dewatering at that part to improve the shapability of that part.

In order to prevent the suction paths of the drying mold from making their marks on a specific portion, e.g., the shoulder of the preform 16, the second fluid can be blown against the portions of the mold 10 corresponding to the other portions than the shoulder in the dewatering step to make the shoulder have a smaller water content than the other portions, and in the drying step a drying mold having no suction paths on the portion corresponding to the shoulder is used. By this manipulation blisters, local burns or color change due to scorching can be avoided to provide a molded article having satisfactory appearance with an extremely smooth surface. The manipulation can be applied not only to the shoulder but the neck, body or bottom.

The water content distribution of the wet preform 16 after dewatering can thus be controlled freely in conformity with the use or the shape of a desired molded article by the above-described dewatering method in which the pressure difference between the supply pressure and the discharge pressure of the dewatering fluid is controlled according to the position of the preform 16.

While in the third embodiment the second fluid is blown to the neck through the second suction paths 14*b,* sufficient effects could be produced in some cases by simply shutting the second suction paths 14*b.* This would be a simpler and more convenient method for obtaining a desired water content distribution.

The above-described method of dewatering is also applicable to the step of heat drying. That is, a preform having been dewatered to a prescribed water content is set in a drying mold heated at a prescribed temperature, and a fluid for drying is fed into the preform and discharged out of the mold in the same manner as in the dewatering while controlling the pressure difference between the supply pressure and the discharge pressure of the drying fluid as described above, thereby to effectively prevent a burnt or color change due to scorching.

While in the above-described embodiments a pressing member is used to press the wet preform to achieve drying, a wet preform of some shape may be dried by use of a pressure forming mold comprising a male and a female.

While the present invention has been described with reference to specific embodiments, it should be understood that the invention is not deemed to be limited thereto. For example, a split mold comprised of three or more splits can be used in place of a split mold comprising two splits. The papermaking mold having a cavity can be replaced with other papermaking molds, such as a combination of a male and a female. The shape of the pulp molded article includes not only bottle containers as hereinabove illustrated but a wide variety of shapes, such as cartons having a rectangular parallelopipedonal shape whose opening and body have substantially the same cross section. Further, the pulp molded articles produced by the method of the present invention include not only hollow containers but other objects such as ornaments.

The portion of the pulp molded article produced by the method of the present invention where a load is to be imposed, such as the opening or the bottom, can be provided with a reinforcing member made of plastics, etc. to secure durability, or a part of such a portion can be made of plastics.

The steps, apparatus, members and the other particulars in the above-described embodiments are interchangeable with each other.

The present invention will now be illustrated in greater detail with reference to Examples. The following Examples are presented as being exemplary of the present invention and should not be considered as limiting. Unless otherwise noted, all the parts and percents are by weight.

EXAMPLES

In Example 1 and Comparative Examples 1 and 2 pulp molded articles were produced. The water content of the preforms was measured in the course of dewatering, and the resulting molded articles were evaluated in uniformity of thickness and color as described below. The results obtained are shown in Table 1.

Example 1

Pulp molded bottles were produced by the use of the apparatus shown in FIG. 1 (capacity of mold 10: 1 liter) as follows. A pulp slurry having the following composition and a temperature of 23° C. was injected into the cavity under a pressure of 0.3 MPa while being sucked through the suction paths to build up pulp fibers on the papermaking net of the mold. After 4 l of the pulp slurry was injected, 2 l of warm water at 50° C. was injected into the cavity under a pressure of 0.3 MPa to raise the pulp slurry temperature in the cavity. Room temperature compressed air was then blown into the cavity to increase the pressure in the cavity to 0.3 MPa for dewatering for 15 seconds. Then a hollow pressing member made of an elastic material was inserted into the preform and inflated with air of 0.5 MPa to press the preform onto the cavity wall for 10 seconds to carry out dewatering.

The mold was opened to take out the dewatered but still wet preform, and the preform was set in a drying mold having the same cavity configuration as the papermaking mold which was heated to 200° C. A hollow pressing member made of an elastic material was inserted into the preform, and air was introduced into the pressing member under a pressure of 1 MPa to press the preform from its inside onto the inner wall of the cavity. When the preform dried sufficiently, the drying mold was opened to take out the bottle, which had an absolute dry weight of 45 g, a height of 240 mm, and a diameter of 80 mm at the body.

Composition of Pulp Slurry

Liquid component: water 99%

Solid component: pulp 1%

Additive (based on the pulp): sizing agent 2%; pigment 0.3%, and aluminum sulfate 2%

Comparative Example 1

Pulp molded articles were produced in the same manner as in Example 1, except that the pulp slurry which had previously been heated to a higher temperature (50° C.) was fed into the cavity.

Comparative Example 2

Pulp molded articles were produced in the same manner as in Example 1, except that the temperature of the pulp slurry was 20° C., and water at 20° C. was used in place of the warm water.

1) Measurement of Water Content

The weight of the preform after dewatering (A g) and the weight of the molded article after absolute drying (B g) were measured. (A−B)/A×100 was taken as a water content after the dewatering.

2) Evaluation of Thickness Unevenness

The dewatered preform was inspected with the naked eye for thickness unevenness. The wall thickness of the dried preform, i.e., the molded article was measured with a micrometer.

3) Evaluation of Color Unevenness

The appearance of the molded article was observed with the naked eye.

TABLE 1

| | Example 1 | Compara. Example 1 | Compara. Example 2 |
|---|---|---|---|
| Slurry Temp. (° C.) | 23 | 50 | 20 |
| Warm Water Temp. (° C.) | 50 | 50 | 20 |
| Cavity Temp. at the Start of Pulp Deposition (° C.) | 23 | 50 | 20 |
| Cavity Temp. at the End of Pulp Deposition (° C.) | 45 | 50 | 20 |

TABLE 1-continued

| | Example 1 | Compara. Example 1 | Compara. Example 2 |
|---|---|---|---|
| Air Dewatering Time (sec) | 15 | 13 | 25 |
| Water Content (%) | 68 | 68 | 68 |
| Pressing Member Dewatering Time (sec) | 10 | 10 | 10 |
| Water Content (%) | 60 | 60 | 62 |
| Thickness Unevenness | none | boring in the body | none |
| Color Unevenness | none | observed | none |

As is apparent from the results in Table 1, the time required for dewatering is shorter in Example 1 than in Comparative Examples 1 and 2, and the molded article of Example 1 has little unevenness in thickness and color as compared with those of Comparative Examples.

Example 2

Pulp molded bottle containers were produced by use of the apparatus shown in FIG. 3. The wet preform before dewatering had a water content of 77%. Dewatering was carried out by blowing superheated steam heated to 220° C. into the cavity to increase the cavity pressure to 294 kPa [gauge] for dewatering for 2 seconds. At this point in time, the water content of the preform was 50%. Superheated steam blowing was continued while discharging part of it through the evacuation line to perform heat drying by heat exchange for 8 seconds. The resulting still wet preform had a water content of 41% as a whole. The water content on the outer side was 45%, and that on the inner side was 32%.

The papermaking mold was opened to take out the wet preform, which was then set in a drying mold having the same cavity configuration as the papermaking mold which was heated to 200° C. A hollow pressing member made of an elastic material was inserted into the preform, and air was introduced into the pressing member under a pressure of 1.5 MPa to press the preform from its inside onto the inner wall of the cavity. When the preform dried sufficiently, the drying mold was opened to take out the bottle, which had an absolute dry weight of 35 g, a height of 240 mm, and a diameter of 80 mm at the body.

Examples 3 to 5

The preform of Example 2 (water content: 77%) was dewatered in the same manner as in Example 2, except that the superheated steam (220° C.) was blown to increase the cavity pressure to 98 kPa[gauge] (Example 3) or 196 kPa [gauge] for dewatering for 2 seconds (Example 4) or superheated steam at 170° C. was blown to increase the cavity pressure to 294 kPa[gauge] for dewatering for 2 seconds (Example 5). At this point in time, the water content of the preform was 61%, 52%, and 52%, respectively.

Example 6

For producing pulp molded bottle containers, the preform of Example 2 (water content: 77%) was dewatered in the same manner as in Example 2, except that compressed air heated to 220° C. was blown in place of the superheated steam to increase the cavity pressure to 294 kPa[gauge] for dewatering for 2 seconds. At this point in time, the water content of the preform was 59%. Blowing heated compressed air was continued while discharging part of it through the evacuation line to perform heat drying by heat exchange for 8 seconds. The resulting preform had a water content of 45% as a whole. The water content on the outer side was 52%, and that on the inner side was 36%.

Examples 7 and 8

The preform of Example 2 was dewatered in the same manner as in Example 6, except that the heated compressed air was blown to increase the cavity pressure to 196 kPa [gauge] for dewatering for 2 seconds (Example 7) or non-heated compressed air at 30° C. was blown, in place of the heated compressed air used in Example 6, to increase the cavity pressure to 196 kPa[gauge] for dewatering for 2 seconds (Example 8). At this point in time, the water content of the preform was 61% or 62%, respectively.

Comparative Example 3

The preform of Example 2 was dewatered in the same manner as in Example 2, except that the superheated steam was blown to increase the cavity pressure to 49 kPa[gauge] for dewatering for 2 seconds. At this point of time, the water content of the preform was 67%.

Comparative Example 4

The preform of Example 2 was dewatered in the same manner as in Example 2, except that compressed air heated to 220° C. was blown in place of the superheated steam to increase the cavity pressure to 98 kPa[gauge] for dewatering for 2 seconds. At this point of time, the water content of the preform was 66%.

Comparative Example 5

The preform of Example 2 was dewatered by using a pressing member made of an elastic material in place of the superheated steam as follows. The pressing member was inserted into the preform, and compressed air at 30° C. (490 kPa) was fed into the pressing member to inflate it thereby to press the preform onto the cavity wall for dewatering for 2 seconds (Comparative Example 5). At this point in time, the water content was reduced to 70 to 75%.

Comparative Examples 6 and 7

The preform of Example 2 was dewatered in the same manner as in Comparative Example 5, except that the dewatering by pressing was continued for 10 seconds (Comparative Example 6) or 30 seconds (Comparative Example 7). At this time point, the water content of the preform was 63% or 60%, respectively.

Example 9

Figure 4B:
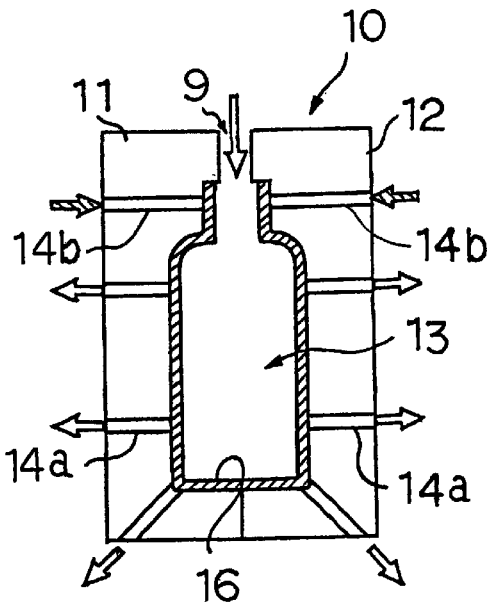

Pulp molded bottle containers were produced by the use of a papermaking mold shown in FIGS. 4A and 4B. Before dewatering, the preform as deposited had a water content of 77%. Dewatering was carried out by blowing superheated steam at 220° C. into the cavity to increase the cavity pressure to 392 kPa[gauge] for dewatering for 3 seconds while blowing steam at 150° C. from the outside of the mold toward the neck of the preform through the second suction paths under a pressure of 392 kPa[gauge].

The preform was taken out of the opened papermaking mold and set in a drying mold heated to 200° C. whose cavity configuration was the same as that of the papermaking mold except that the inner portion corresponding to the neck of the preform had screw threads. A pressing member made of an elastic material was inserted into the preform, and air was introduced into the pressing member under a pressure of 1 MPa to press the preform onto the inner wall of the cavity to thereby heat dry the preform and to transfer the configuration of the cavity to the preform. When the preform dried sufficiently and the configuration was sufficiently transferred, the drying mold was opened to take out a bottle molded article. The resulting molded article had an absolute dry weight of 38 g, a height of 240 mm, and a diameter of 80 mm at its body.

The resulting molded article had a water content of 58% as a whole. The water content at the neck, the shoulder, the body, the bottom, and the bottom corner was 57%, 51%, 54%, 58%, and 59%, respectively.

Example 10

A pulp molded article was produced in the same manner as in Example 9, except that compressed air was blown against the neck of the preform through the second suction paths under pressure of 539 kPa[gauge] in place of the steam.

The resulting molded article when taken out of the mold had a water content of 57% as a whole. The water content at the neck, the shoulder, the body, the bottom, and the bottom corner was 61%, 52%, 52%, 58%, and 63%, respectively.

As described above, the method of the present invention provides a pulp molded article with little thickness unevenness at a reduced cost of energy and without impairing the effects of additives.

According to the present invention, a wet pulp preform can be dewatered and dried efficiently. The main principle of dewatering does not consist in heat exchange, which is advantageous for energy saving. The dewatering can be achieved in an extremely short time, which leads to reduction of the production time. The blowing pressure being relatively low, the papermaking net hardly leaves its mark on the molded article, securing satisfactory appearance.

Where the dewatering step with the superheated steam or the heated or non-heated compressed air is followed by a heat drying step in which blowing the superheated steam or the heated compressed air is continued or blowing the non-heated compressed air is switched to blowing heated compressed air while discharging the blown superheated steam or the blown heated compressed air through an inlet through which the dewatering fluid is blown, the resulting preform has its water content gradually increased from its inner side to the outer side. Such a water content gradation brings about improvement in transfer of the cavity configuration to the preform, and accelerates heat exchange to improve the efficiency of heat drying.

According to the present invention, it is possible to control the water content distribution of a dewatered wet pulp preform. In other words, the degree of dewatering and/or drying in a specific part of a wet preform can be controlled so as to facilitate shaping of that part in the heat drying step and to prevent scorching. According to this method of the invention, the dewatering time can be shortened, and a burnt or color change due to scorching can be prevented.

The invention being thus described, it will be obvious that the same can be varied in many ways. Such variations are not to be regarded as a departure from the spirit and scope of the invention, and all such modifications as would be obvious to one skilled in the art are intended to be included within the scope of the following claims.

What is claimed is:

1. A method of producing a pulp molded article, the method comprising the steps of:

feeding a pulp slurry to a surface of a papermaking mold having suction paths to suck water contained in the pulp slurry;

sucking water, contained in the fed pulp slurry, through the suction paths;

depositing a pulp of the fed pulp slurry on the surface of the papermaking mold;

simultaneously with the depositing of the pulp, raising a temperature of the fed pulp slurry;

forming a wet pulp preform; and dewatering the wet pulp preform.

2. The method for producing a pulp molded article according to claim 1, wherein the raising of the temperature of the fed pulp slurry is accomplished by adding a fluid for temperature rise to the fed pulp slurry or heating the fed pulp slurry by a heating means.

3. The method for producing a pulp molded article according to claim 2, wherein the adding of the fluid for temperature rise is done either simultaneously with the feeding of the pulp slurry or after the start of the feeding of the pulp slurry.

4. The method of producing a pulp molded article according to claim 1, wherein the feeding of the pulp slurry is accomplished via a feeding means, including a feed pump, a feed pipe, a flow meter, and a three-way valve, which sucks up the pulp slurry contained in a pulp slurry tank and feeds the pulp slurry under pressure to an inside of a cavity of the papermaking mold towards an inner surface thereof.

5. The method of producing a pulp molded article according to claim 1, wherein the papermaking mold includes two mirror-image portions which can be separated from each other in order to remove the pulp molded article from the papermaking mold once the pulp molded article is completely formed and dried.

6. A method for producing a pulp molded article, the method comprising the steps of:

feeding a pulp slurry into an inside of a cavity of a papermaking mold and towards an inner surface thereof, the papermaking mold having suction paths leading from the inner surface thereof toward an outer surface thereof;

evacuating the cavity from the inner surface toward an outer side of the papermaking mold via the suction paths;

forming a wet pulp preform on the inner surface of the papermaking mold; and blowing a dewatering fluid into the cavity in a closed state to dewater the wet pulp preform, wherein the dewatering fluid is superheated steam, and the blowing of the superheated steam as the dewatering fluid to form a blown superheated steam is done in such a manner that a pressure in the cavity increases to 98 kPa(gauge) or higher.

7. The method for producing a pulp molded article according to claim 6, wherein the dewatering step, with the superheated steam as the dewatering fluid, is followed by a heat drying step in which the blowing of the superheated steam as the dewatering fluid is continued, while discharging either a part of the blown superheated steam or an entirety of the blown superheated steam through an inlet through which the dewatering fluid is blown.

8. The method for producing a pulp molded article according to claim 6, comprising adjusting a difference between a supply pressure of the dewatering fluid into the cavity and a discharge pressure of the dewatering fluid in a site where the dewatering fluid, fed into the cavity, has penetrated through the wet pulp preform and which leads to the outer side of the papermaking mold and thereby, controlling an amount of the dewatering fluid passing through a prescribed portion of the wet pulp preform.

9. The method of producing a pulp molded article according to claim 6, further comprising opening an evacuation line and discharging the dewatering fluid through the evacuation line simultaneously with the blowing of the dewatering fluid into the cavity.

10. The method of producing a pulp molded article according to claim 6, wherein the feeding of the pulp slurry is accomplished via a feeding means, including a feed pump, a feed pipe, a flow meter, and a three-way valve, which sucks up the pulp slurry contained in a pulp slurry tank and feeds the pulp slurry under pressure to the inside of the cavity of the papermaking mold towards the inner surface thereof.

11. The method of producing a pulp molded article according to claim 6, wherein the papermaking mold includes two mirror-image portions which can be separated from each other in order to remove the pulp molded article from the papermaking mold once the pulp molded article is completely formed and dried.

* * * * *